US011351588B2

(12) United States Patent
Gover et al.

(10) Patent No.: US 11,351,588 B2
(45) Date of Patent: Jun. 7, 2022

(54) FORMING HOOPS FOR GROW HOUSES

(71) Applicant: Redoux Industries LLC, Simi Valley, CA (US)

(72) Inventors: Joseph Gover, Simi Valley, CA (US); Tony Stephens, Simi Valley, CA (US)

(73) Assignee: Redoux Industries LLC, Simi Valley, CA (US)

( * ) Notice: Subject to any disclaimer, the term of this patent is extended or adjusted under 35 U.S.C. 154(b) by 0 days.

(21) Appl. No.: 17/410,992

(22) Filed: Aug. 24, 2021

(65) Prior Publication Data

US 2022/0072597 A1 Mar. 10, 2022

Related U.S. Application Data

(60) Provisional application No. 63/076,636, filed on Sep. 10, 2020.

(51) Int. Cl.
*B21D 11/02* (2006.01)
*B21D 11/22* (2006.01)

(52) U.S. Cl.
CPC ..... *B21D 11/02* (2013.01); *B21D 11/22* (2013.01)

(58) Field of Classification Search
CPC ..... B21D 11/02; B21D 11/22; B21D 7/00; B21D 7/02; B21D 7/04; B21D 7/06; B21D 7/066; B21D 9/08
USPC ..... 72/31.04; 73/369, 389.1, 389.3, 389.6
See application file for complete search history.

(56) References Cited

U.S. PATENT DOCUMENTS 1,164,698 A 12/1915 Artz
1,315,937 A 9/1919 Artz
1,461,471 A 7/1923 Bancroft et al.
1,865,025 A 6/1932 Flanagan et al.
(Continued)

FOREIGN PATENT DOCUMENTS

CN 102581090 11/2013
EP 1002591 5/2000
(Continued)

OTHER PUBLICATIONS

Euromac Channel; Bending Machines—Solid Round Bar Bending; YouTube Video; Mar. 22, 2013; https://www.youtube.com/watch?v=dzpMhIjr5CE.
(Continued)

*Primary Examiner* — Jessica Cahill
*Assistant Examiner* — Smith Oberto Bapthelus
(74) *Attorney, Agent, or Firm* — SoCal IP Law Group LLP; Guy L. Cumberbatch; Steven C. Sereboff

(57) ABSTRACT

A tube bending system having a frame, one or more static dies, one or more sliding dies and one or more motors for bending tubes, such as metal tubes, in the form of hoops to create a framework for a greenhouse. The system may include separately leveled frames including a central frame supporting the middle of an arch die, and a pair of lateral frames supporting the lateral sides of the die. An apex clamp on the central frame holds the middle of a straight tube blank against the arch die, while a pair of bending carriages on the lateral frames are displaced to bend the tube blank around the arch die. The apex clamp may move both vertically and longitudinally to cycle between holding the tube blank against the arch die, ejecting the bent tube from the die, and retracting to enable placement of another straight tube.

20 Claims, 15 Drawing Sheets

(56) References Cited

U.S. PATENT DOCUMENTS

| | | | | |
|---|---|---|---|---|
| 2,357,027 | A | 8/1944 | Seifreid | |
| 2,378,413 | A | 6/1945 | Lermont et al. | |
| 2,437,092 | A | 3/1948 | Greene et al. | |
| 2,459,132 | A | 1/1949 | Nielsen | |
| 2,151,752 | A | 7/1950 | Wrightman et al. | |
| 2,527,412 | A | 10/1950 | Green | |
| 2,729,265 | A | 1/1956 | Jones | |
| 2,753,915 | A | 7/1956 | Raynes | |
| 2,759,513 | A | 8/1956 | Green | |
| 2,887,141 | A | 5/1959 | Bower et al. | |
| 2,889,864 | A | 6/1959 | Bowser | |
| 2,945,528 | A | 7/1960 | Roux | |
| 3,025,904 | A | 3/1962 | De Marco | |
| 3,429,157 | A | 2/1969 | Huth | |
| 4,311,031 | A | 1/1982 | Schwarze | |
| 5,237,847 | A | 8/1993 | Owens | |
| 5,551,271 | A * | 9/1996 | Gray | B21D 7/06 72/213 |
| 6,298,706 | B1 | 10/2001 | Dunn | |
| 6,523,388 | B1 | 2/2003 | Winton | |
| 6,644,087 | B1 | 11/2003 | Ralph | |
| 6,931,908 | B1 | 8/2005 | Miller | |
| 9,314,830 | B2 * | 4/2016 | Tremblay | B21D 7/066 |

FOREIGN PATENT DOCUMENTS

| | | |
|---|---|---|
| GB | 329344 | * 12/1929 |
| WO | 1993022078 | 11/1993 |
| WO | 1994022609 | 10/1994 |

OTHER PUBLICATIONS

Allswage UK; Pipe Bending for Steel Tubes C42; YouTube Video; Apr. 29, 2014; https://www.youtube.com/watch?v=k5xwmZ9Lxp4.
Euromac Channel; Bending Machines—Thick Bar Bending; YouTube Video; Mar. 22, 2013; https://www.youtube.com/watch?v=pGyZ-Zkzwv0.

* cited by examiner

FORMING HOOPS FOR GROW HOUSES

RELATED APPLICATION INFORMATION

This application claims priority from U.S. Provisional Application No. 63/076,636, filed Sep. 10, 2020.

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by anyone of the patent disclosure as it appears in the Patent and Trademark Office patent files or records, but otherwise reserves all copyright and trade dress rights whatsoever.

BACKGROUND

Field

This disclosure relates to bending systems and methods such as for bending tubes and, in particular, to a system and method for bending tubes into partial hoops for grow houses.

Description of the Related Art

Bent metal tubing has various uses, including providing an underlying structure for greenhouse roofs, tunnels, or canopies ("hoop houses"). Although these structures are typically relatively low cost and easy to construct, the difficulty of bending metal tubes appropriately and efficiently has led to such structures being both expensive and labor intensive to construct.

The most commonly used method to bend metal tubing is through the use of a tubing roller. A tubing roller generally consists of a large wheel with a hand crank. The metal tube is placed in a cavity at the bottom of the large wheel, and the user must then crank the wheel using the hand crank in order to shape the tubing (with the tubing passing through the roller multiple times, depending on the desired radius). This method, however, is very inefficient, as it requires a large amount of physical labor and is very time-consuming.

Another common method for bending metal tubing is utilizing a three-roll bender, which generally consists of three smaller wheels and a hand crank. Specifically, a metal tube is generally placed within a gap located between the three wheels and a hand crank or motor actuated in order to shape the tubing. Depending on the desired radius, the tubing is typically passed through the bender multiple times. Although the three-roll bender is less labor intensive than the tubing roller, it is still overly time intensive methods for bending metal tubing.

SUMMARY

A tube bending system as shown in the figures has a frame, one or more static dies, one or more sliding dies and one or more motors. The bending device may be constructed mostly of steel. The bending device may be used to bend tubes, such as metal tubes, in the form of hoops. The hoops may be set up in a field to create a framework for a greenhouse.

The tube bending system may include a series of separate and separately leveled frames that together define a support platform for an arch die. A central frame supports the middle of the arch die, and a pair of lateral frames support the lateral sides of the die. An apex clamp on the central frame holds the middle of a straight tube blank against an apex point on the arch die, while a pair of bending carriages on the lateral frames are displaced to bend the tube blank around the arch die. The apex clamp may move both vertically and longitudinally to cycle between holding the tube blank against the arch die, ejecting the bent tube from the die, and retracting to enable placement of another straight tube.

Throughout this description, elements appearing in figures are assigned three-digit reference designators, where the most significant digit is the figure number and the two least significant digits are specific to the element. An element that is not described in conjunction with a figure may be presumed to have the same characteristics and function as a previously-described element having a reference designator with the same least significant digits.

DETAILED DESCRIPTION

Description of Apparatus

Figure 1:
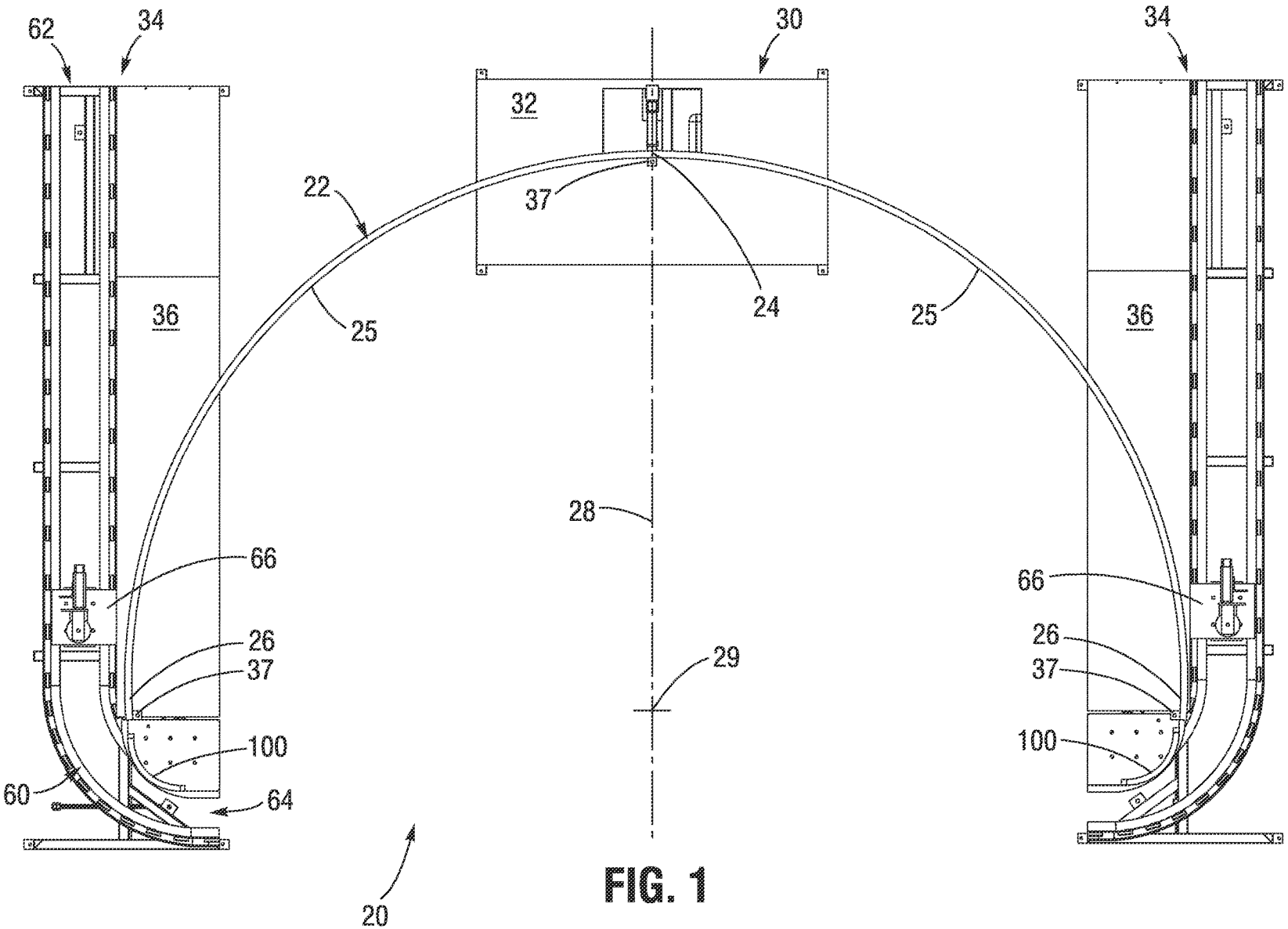
FIG. 1 is a top plan view of a tube bending system.
Figure 2:
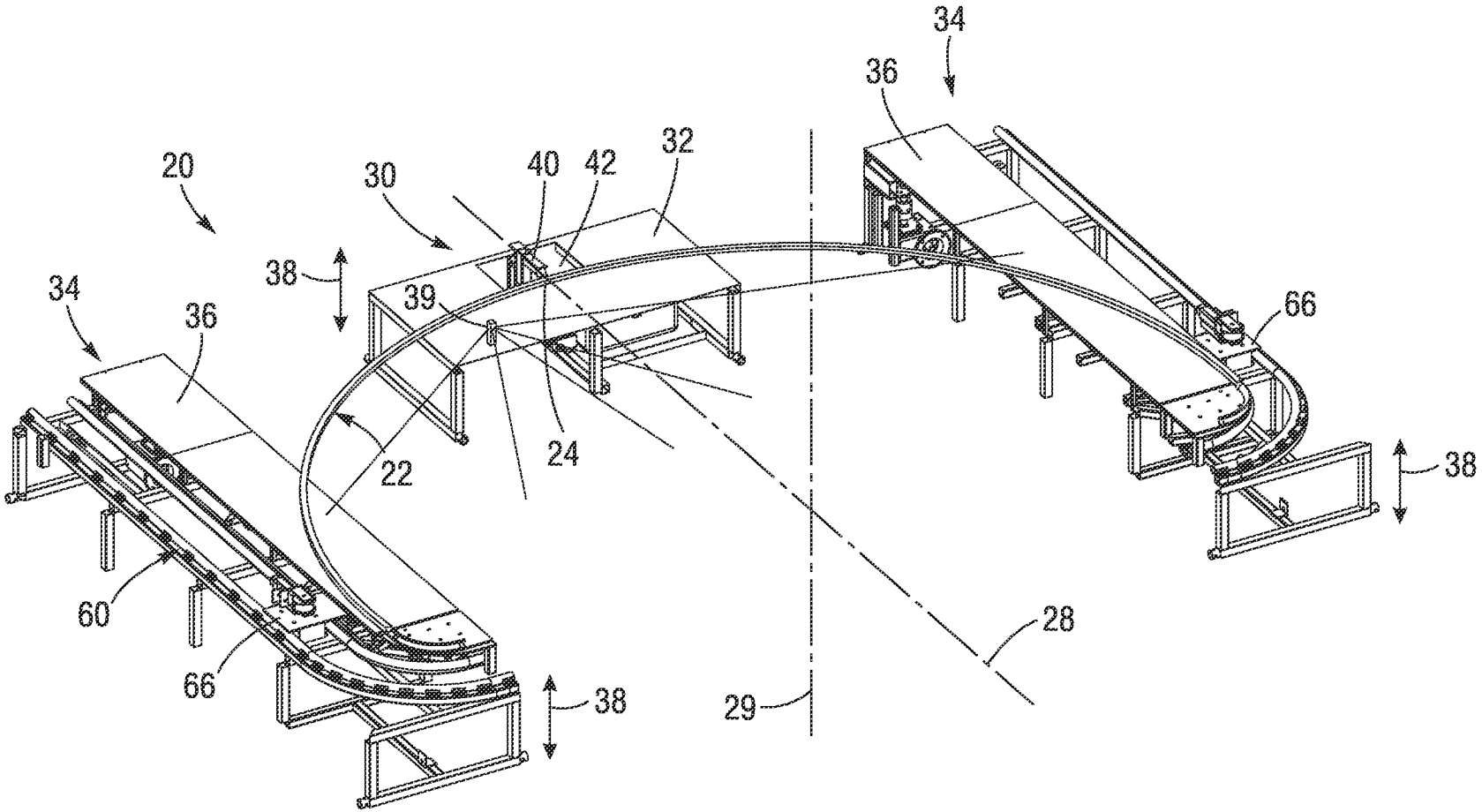
FIG. 2 is a perspective assembled view of the tube bending system.
Figure 3:
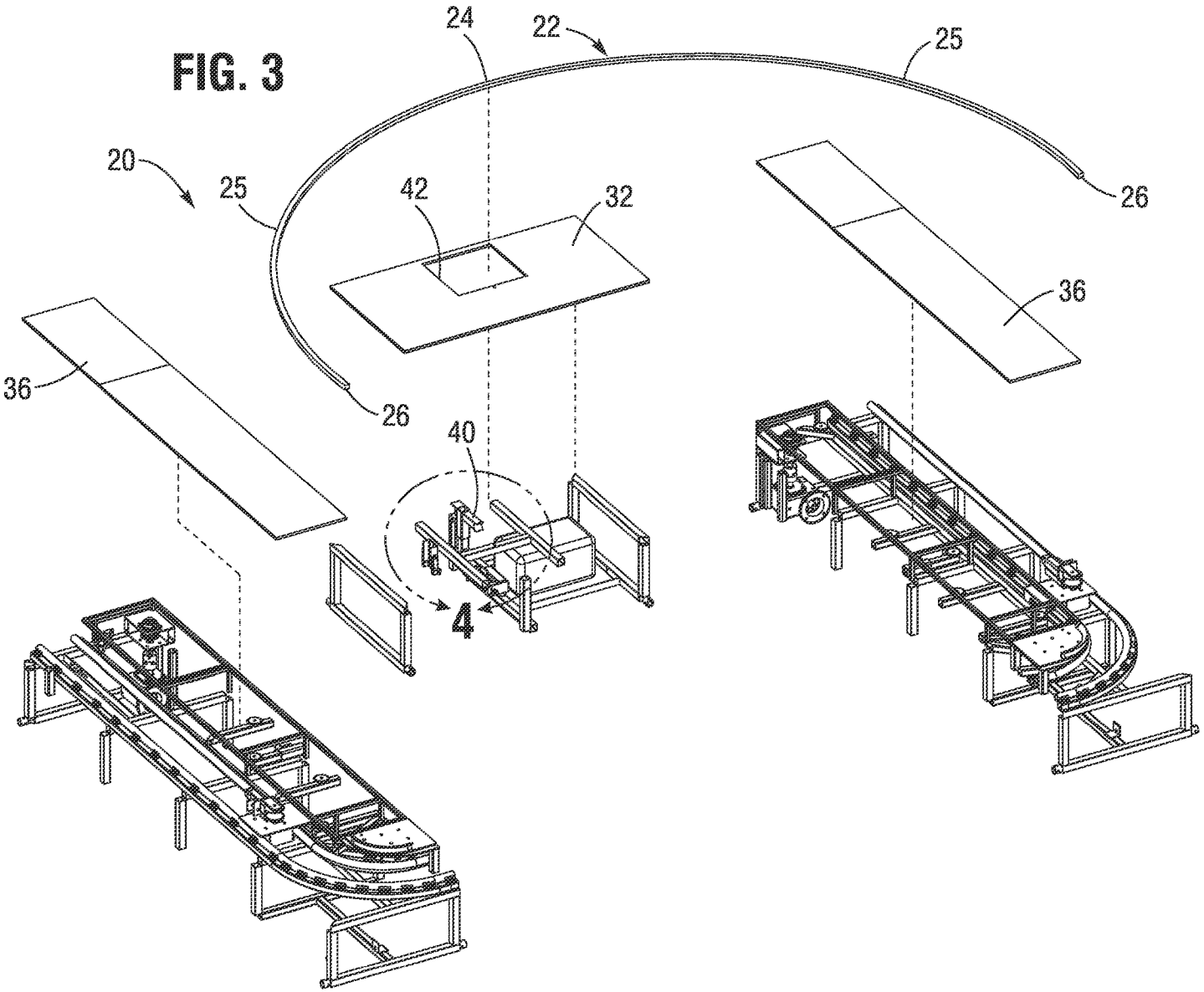
FIG. 3 is a perspective exploded view of the tube bending system.

Referring now to the figures and, initially, to FIGS. 1-3, a tube bending system 20 for bending tube blanks into partial hoops is shown. The tube bending system 20 comprises an arch die 22 having a curved, generally semi-circular shape with two sides curving away from a central apex point 24 on two identical sides 25 to end points 26. The arch die 22 comprises a rigid, e.g., steel, member having a convex outer surface opposite a concave inner surface. A longitudinal plane 28 is defined radially through the apex point 24, bisecting the two sides and extending through a central vertical axis 29 of the curved shape. For the purpose of nomenclature, the two sides 25 of the arch die 22 are located laterally left and right across the longitudinal plane 28, and may be identical and mirror images of each other.

Figure 8B:
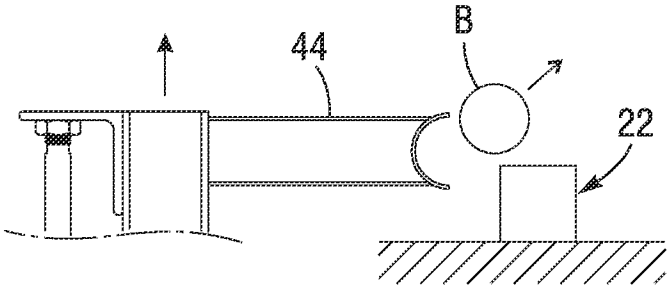
FIGS. 8A-8C are side elevational views of the apex clamp and several stages of operation thereof.
Figure 8C:
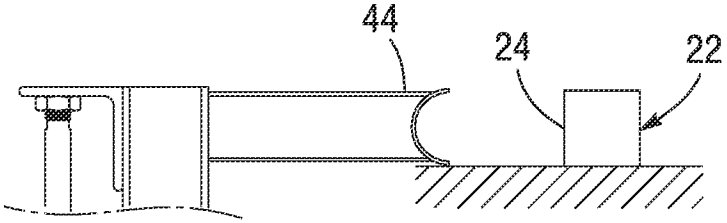
Figure 8A:
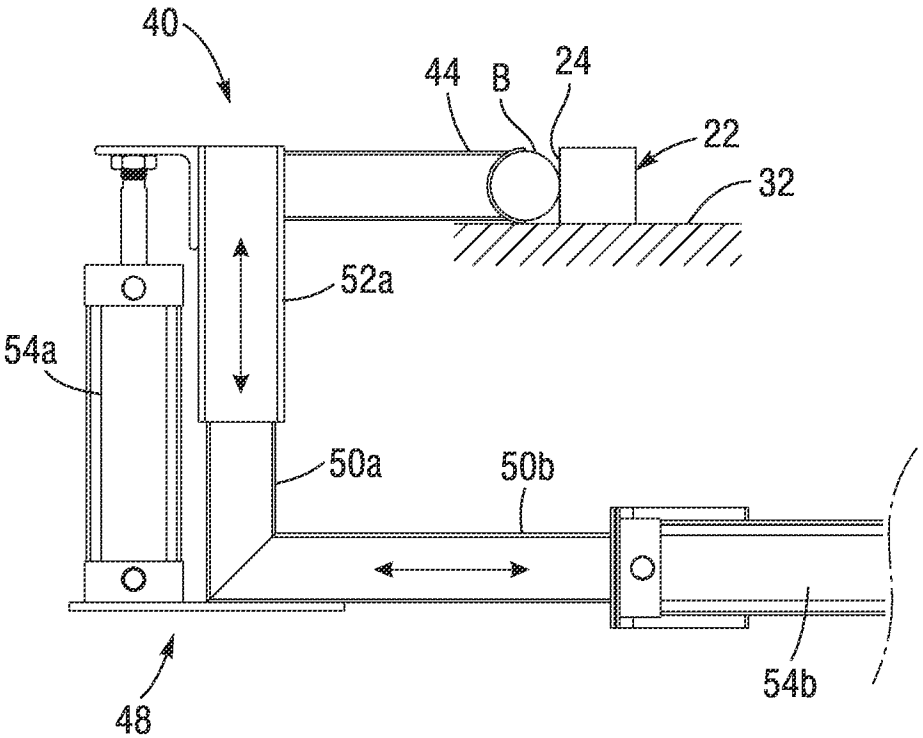

The arch die 22 is supported in a horizontal orientation across several discrete stationary frame members. More particularly, a stationary central frame 30 has a table surface or horizontal platform 32 on which is mounted a central portion of the arch die 22. The convex outer surface of the arch die 22 has a vertical thickness at least as tall as a tube blank B placed on the horizontal platform 32, as seen in FIG. 8A. A pair of stationary lateral frames 34 separate from and positioned on opposite lateral sides of the central frame 30 each has a table surface or horizontal platform 36 on which is mounted one of the two sides 25 of the arch die 22. The lateral frames 34 are spaced apart from the central frame 30 such that a linear tube blank B clamped against the apex point 24 may be supported across the horizontal platforms 32, 36 of the central 30 and lateral frames 34, as seen in FIG. 6A.

The central frame 30 and lateral frames 34 are desirably constructed of a series of struts welded or fastened together in generally rectilinear combinations; the struts in the illustrated embodiment are shown as square metallic tubes, but may also be tubular or other suitable variant. The materials used for the struts may be galvanized steel, aluminum, or the like. The horizontal platforms 32, 36 may be formed from a variety of materials, including metal, plywood, etc. In one embodiment, the platforms 32, 36 are formed of a wire mesh for the sake of weight savings and visibility below the platforms.

Figure 6A:
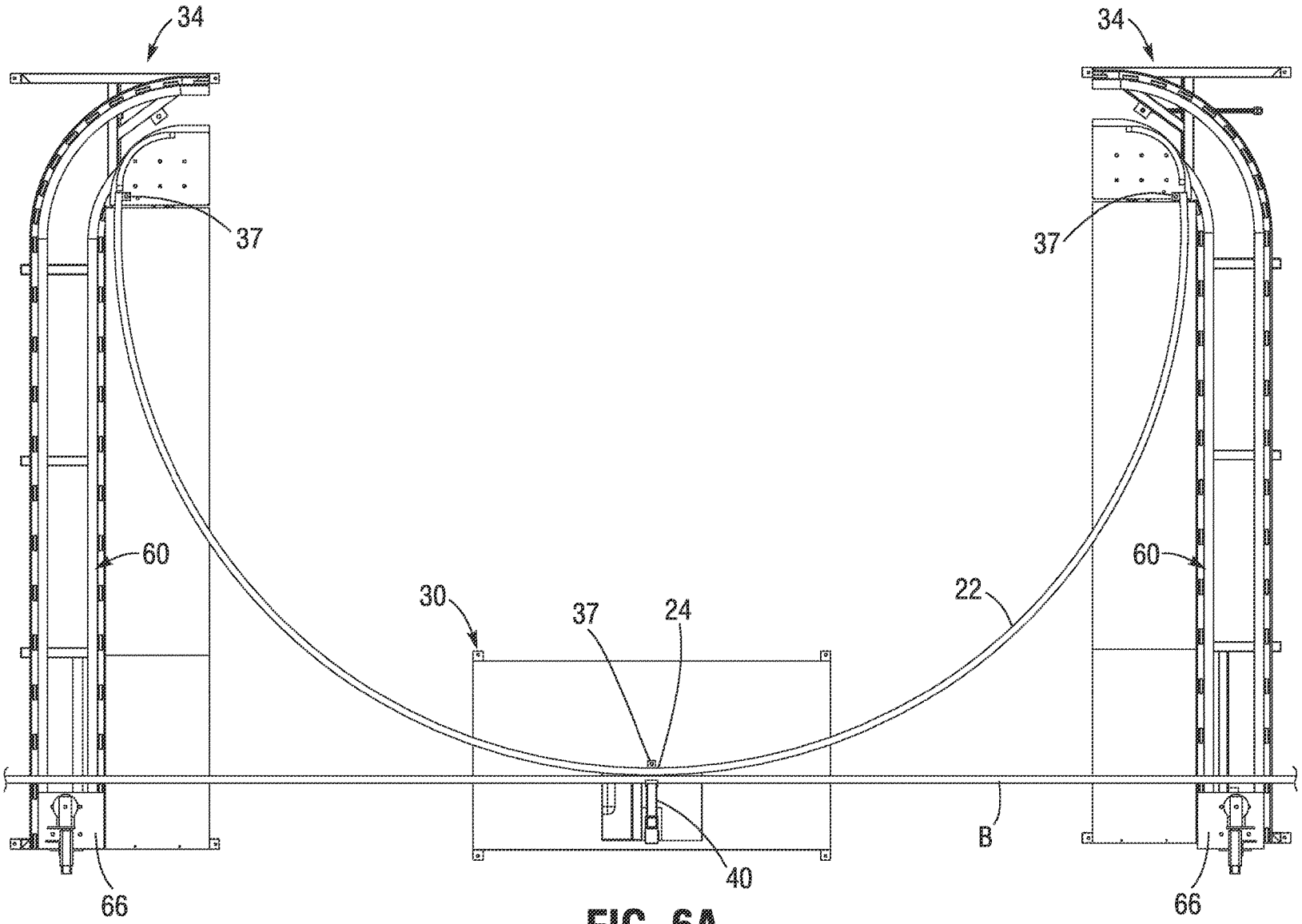
FIGS. 6A-6F are top plan views of the tube bending system showing a sequence of operation.

FIGS. 1 and 6A show three mounting brackets 37 that are welded to an inner curvature of the arch die 22 and used to secure the arch die to the central frame 30 and lateral frames 34. More particularly, the mounting brackets 37 have apertures through which mounting bolts can be passed so as to secure the arch die 22 two solid struts underneath the platforms 32, 36 of the respective frames 30, 34. When a tube blank B is bent around the arch die 22, the forces are radially directed, and the arch die 22 is rigid enough to withstand deformation with just these three mounting locations.

FIG. 2 indicates with double-headed arrows 38 that each of the central frame 30 and two lateral frames 34 are separately height-adjustable. For example, the feet of the respective frames 30, 34 may have threaded adjustment pads, or the vertical struts that form the frames themselves may be vertically adjustable. A leveling gauge such as a laser sight 39 may be utilized to ensure that the central platform 32 and side platforms 36 are in the same horizontal plane. Once properly leveled, the arch die 22 can then be placed on top of the three frames 30, 34 and secured using the mounting brackets 37. The ability to easily assemble and disassemble the frames 30, 34 enables the entire system to be more easily transported, such as on a standard pickup-pulled trailer, and assembled in the field with only a couple of workers. This stands in contrast to prior systems which were fully integrated such that the entire assembly was one component requiring a large truck to transport and forklift to move.

As seen in FIG. 2, and in more detail in FIGS. 7-8, an apex clamp 40 extends from below through an aperture 42 to project above the horizontal platform 32 of the central frame 30. The apex clamp 40 has a clamp end 44 projecting longitudinally toward the apex point 24 on the convex outer surface of the arch die 22. In one embodiment, the clamp end 44 terminates in a concave channel piece 46 (see FIG. 7B) that closely matches an outer diameter of the tube blank B so as to firmly hold the tube blank against the arch die 22. The arch die 22 may also have a concave vertical profile to receive the tube blank, but is desirably a square tube so that its convex outer surface has a vertical profile that enables easy ejection of the tube blank when bent, as will be seen.

The apex clamp 40 incorporates a reciprocating movement mechanism 48 adapted to displace the clamp end 44 to and from a clamping position both longitudinally and vertically. More particularly, the clamp end 44 has a starting position for placement of a tube blank B on the horizontal platform between the clamp end and the apex point 24, as seen in FIG. 8C. The movement mechanism 48 is configured to displace the clamp end 44 to a clamping position as seen in FIG. 8A and hold a tube blank B against the apex point 24. Finally, the movement mechanism 48 is further capable of ejecting the tube blank B upward from the clamping position as shown in FIG. 8B.

Figures 7, 7A:
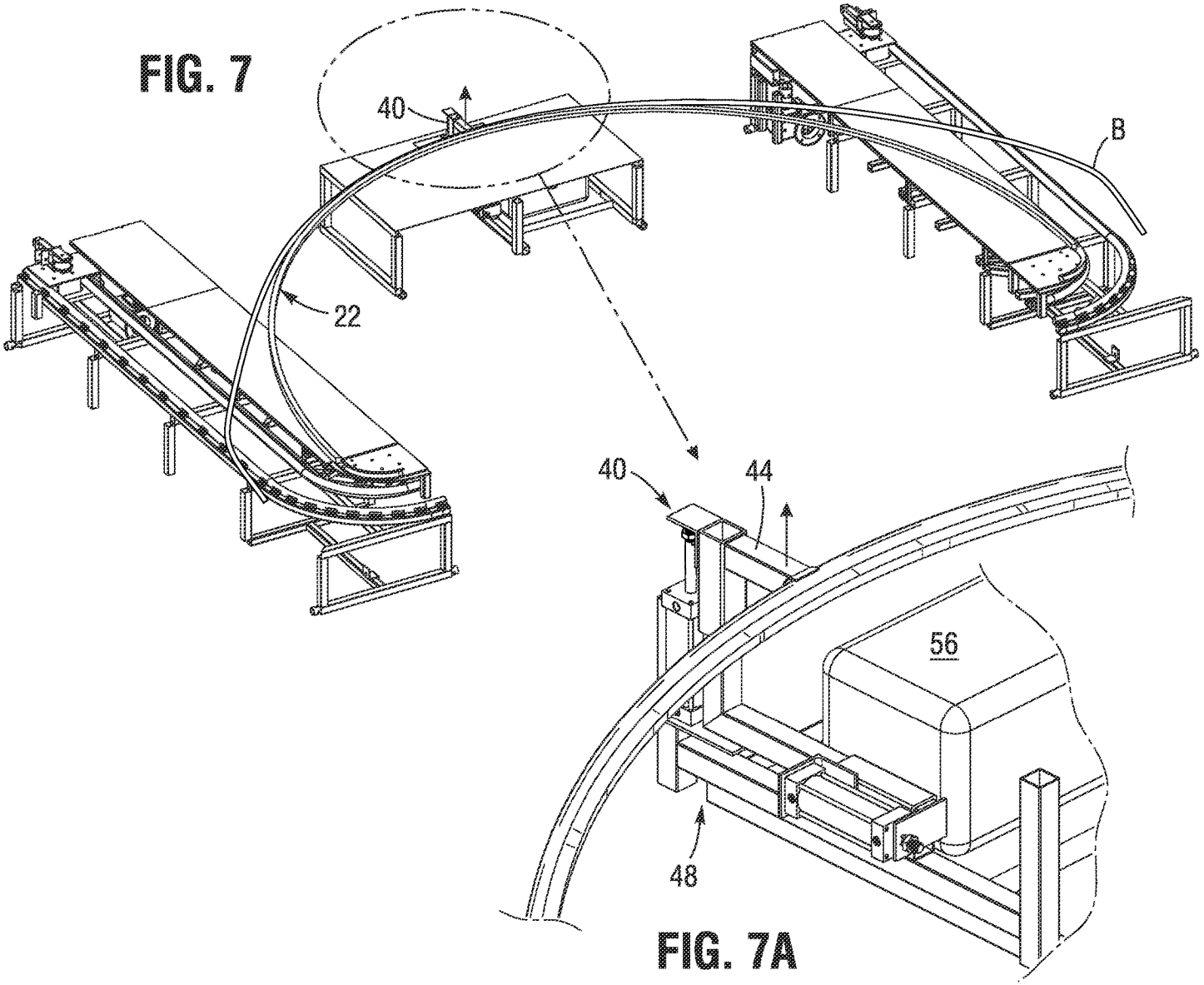
FIG. 7 is a perspective view of the tube bending system after bending a tube blank into a partial hoop.
FIGS. 7A and 7B are enlarged views of an exemplary apex clamp used to hold the tube blank and then eject the partial hoop.
Figure 7B:
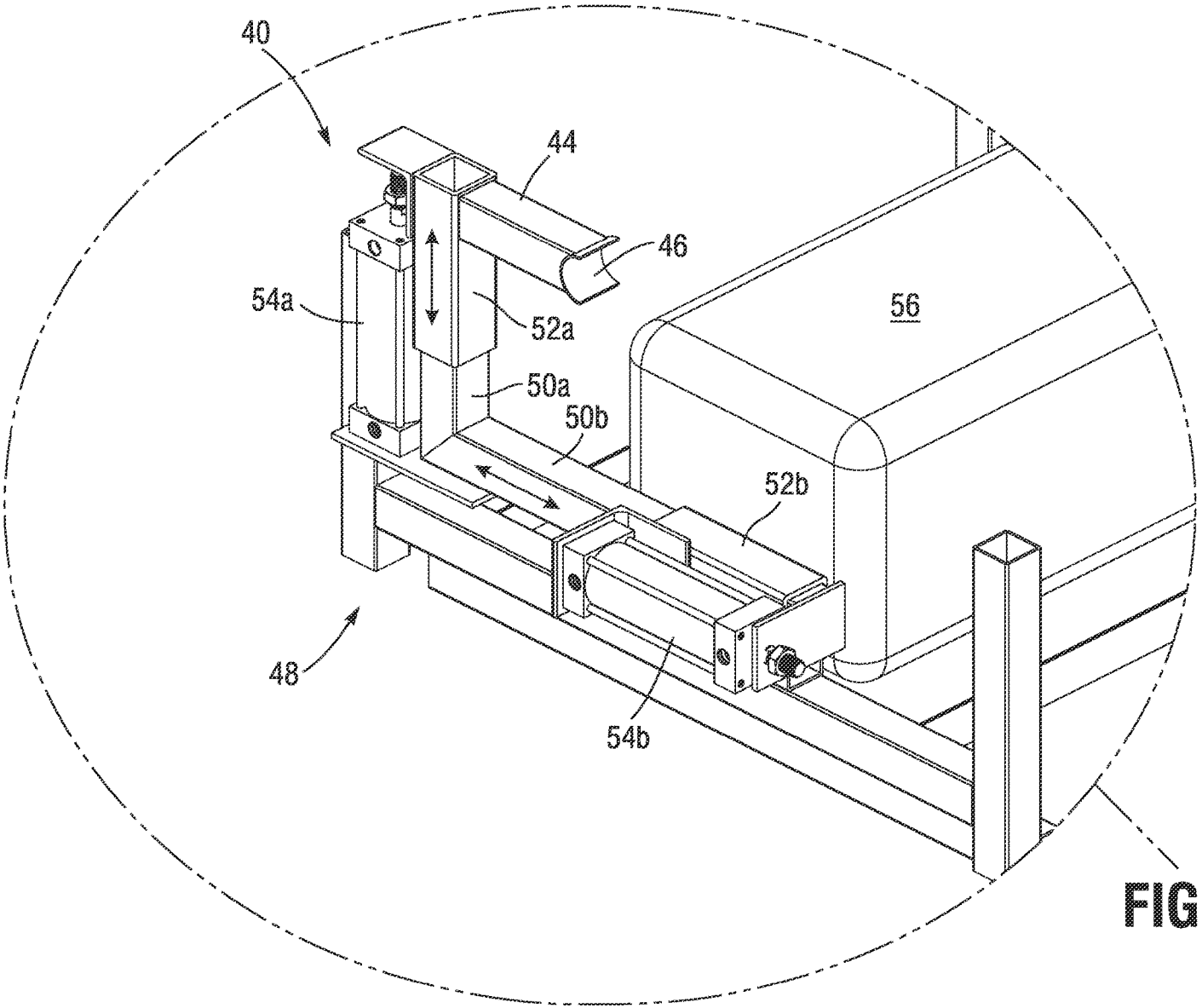

As shown in FIG. 7B, a movement mechanism 48 comprises a pair of (e.g., square) beams 50*a*, 50*b* that are secured together at right angles and telescopically arranged to slide within a larger pair of tubes or channels 52*a*, 52*b*. A vertical first channel 52*a* rigidly connects to the clamp end 44 and is displaced up and down relative to the vertical beam 50*a* by a first linear actuator 54*a*. A horizontal second channel 52*b* rigidly connects to the central frame 30, and the horizontal beam 50*b* is displaced forward and backward through the second channel by a second linear actuator 54*b*. The linear actuators 54*a*, 54*b* are desirably hydraulic, though other prime movers such as jackscrews are contemplated. A control unit 56 having a processor and logic coordinates the timing of movement of the linear actuators 54*a*, 54*b*, and is also connected to activate tube bending carriages provided on the lateral frames 34, as will be described below.

Figure 4B:
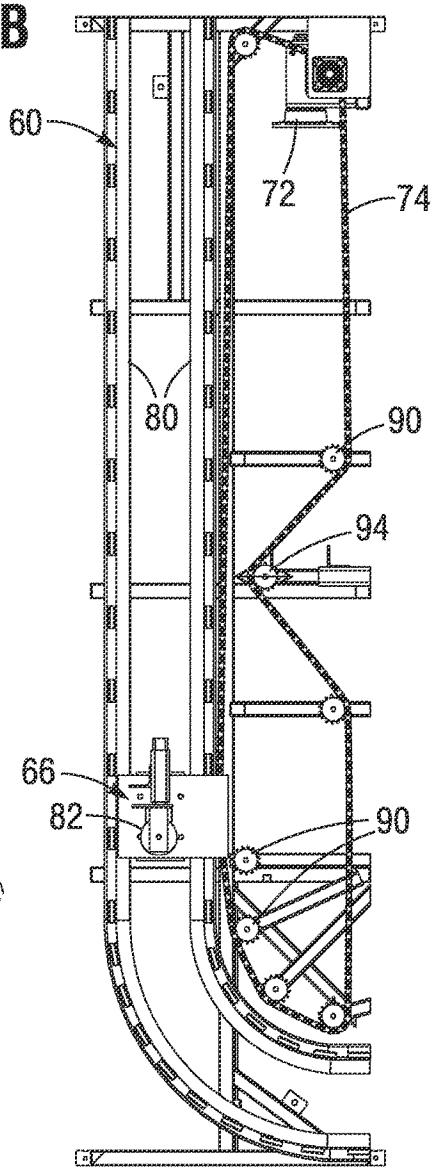
FIG. 4A and FIG. 4B are perspective and plan views of one of a pair of lateral frames of the system with an upper support platform removed to expose a bending carriage and drive mechanism incorporated therein.
Figure 4A:
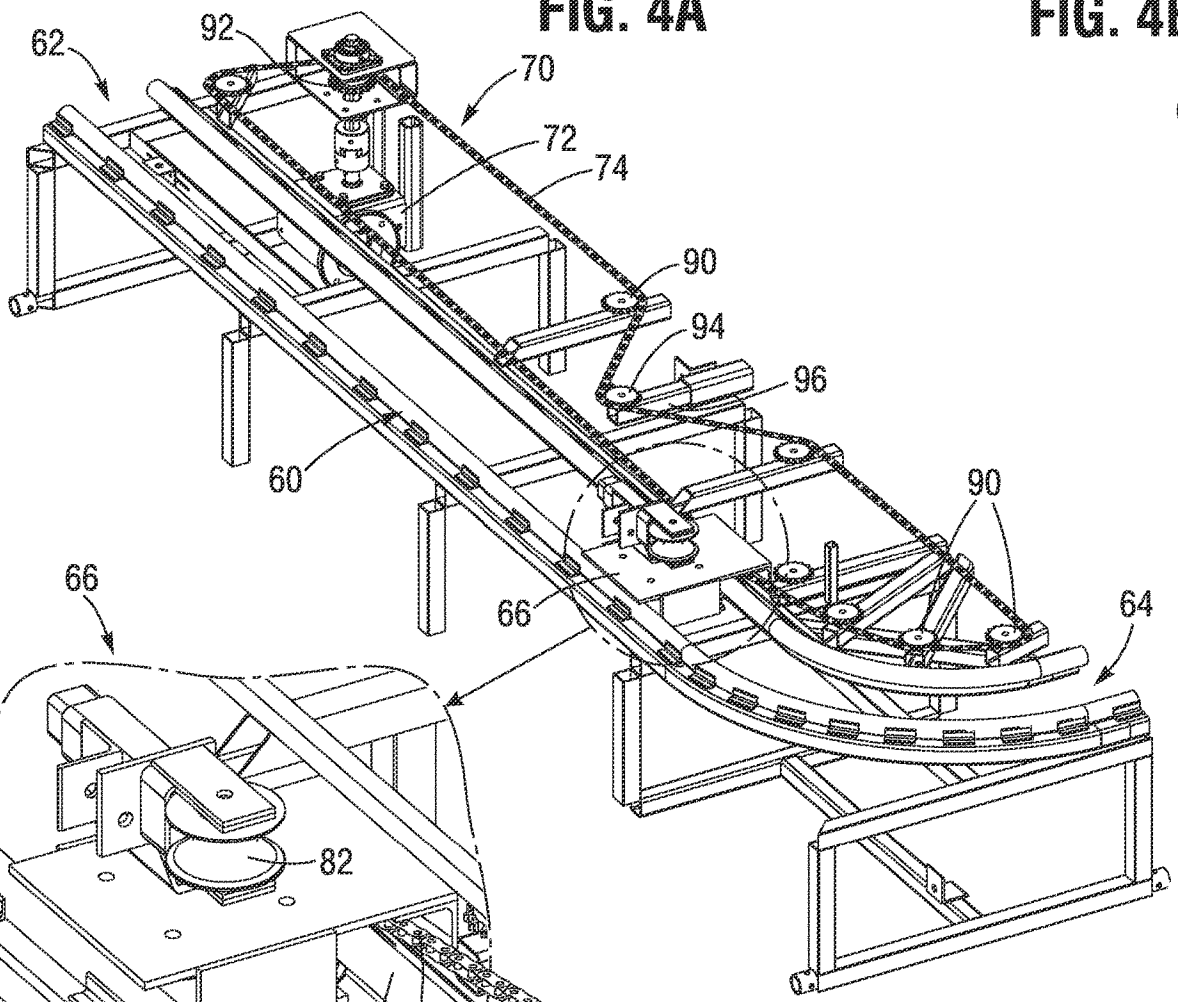
Figure 4C:
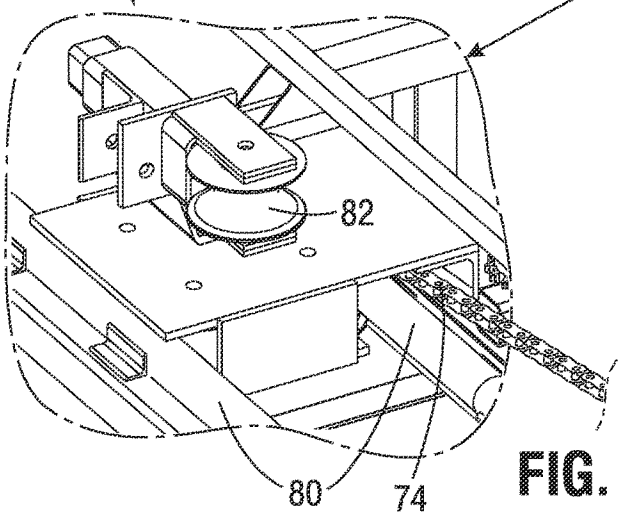
FIGS. 4C-4F are perspective and detailed views of the bending carriage, illustrating one way for coupling a chain of the drive mechanism thereto.

With reference back to FIGS. 1-3, and also FIGS. 4A-4C, each lateral frame 34 supports a horizontal railway 60 extending longitudinally forward from a starting location 62 approximately laterally even with the apex clamp 40 to an ending location 64 laterally even with or slightly past respective terminal ends 26 of the two sides 25 of the arch die 22. Each railway 60 provides a guide for a bending carriage 66 which reciprocates longitudinally between the starting and ending locations 62, 64. As shown in FIG. 4A, the bending carriages 66 are displaced along the railways 60 by a drive mechanism 70, which in the illustrated embodiment incorporates a motor 72 and an elongated chain 74, along with associated transmission and gears.

Each railway 60 extends longitudinally along the majority of its length, and then course inward to end at a generally lateral orientation at the ending location 64. That is, each railway 60 forms somewhat of a J-shape and makes an approximately 90° bend at the end.

Figure 4F:
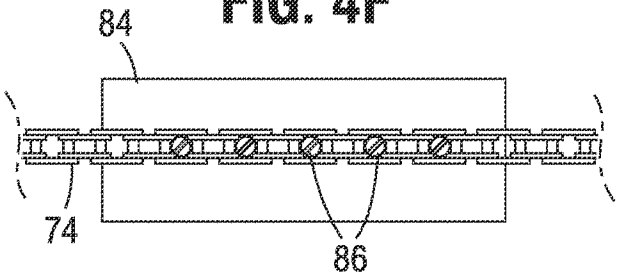
Figure 4E:
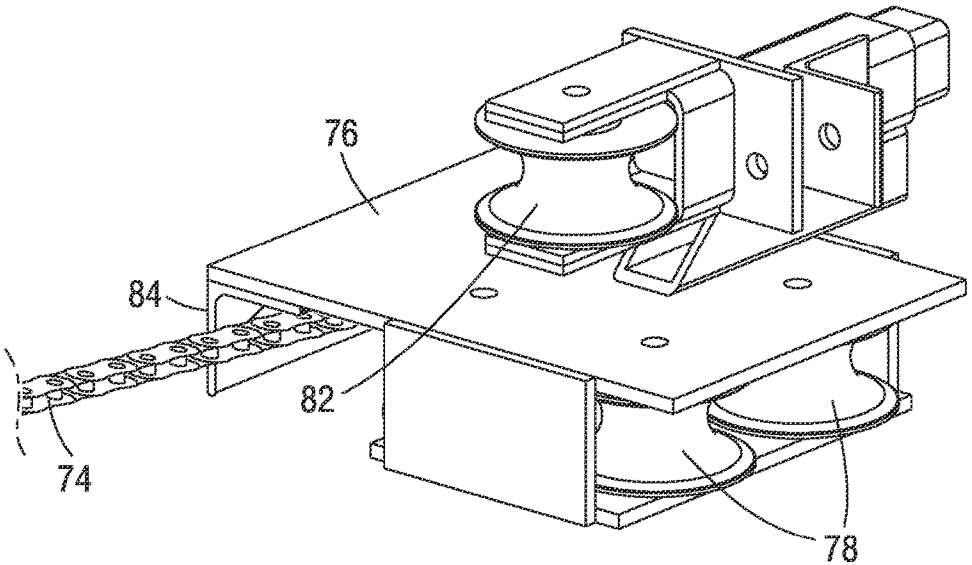
Figure 4D:
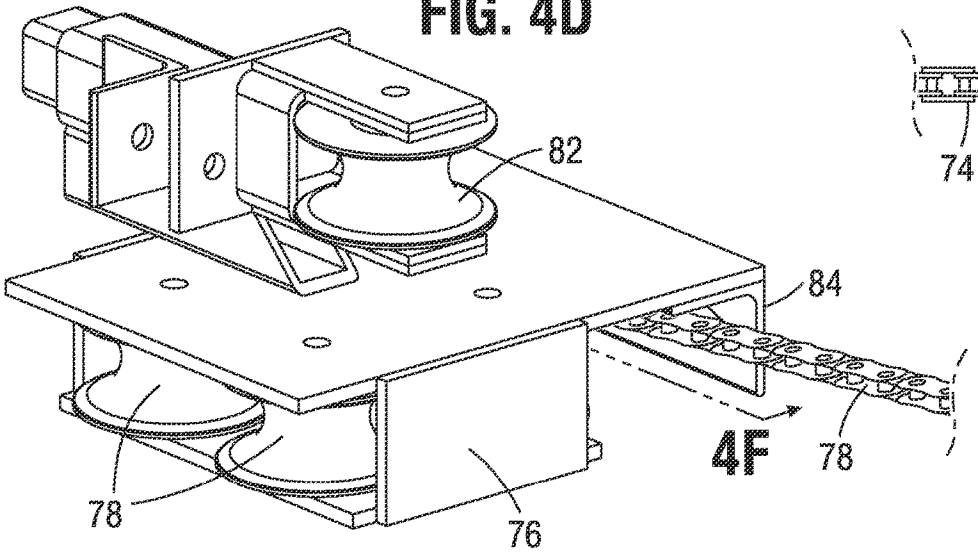

As seen in FIGS. 4C-4E, the bending carriages 66 each comprises a generally H-shaped car 76 formed of various plates and having a plurality of concave guide rollers 78 mounted about vertical axes and exposed on both lateral sides. The railways 60 may comprise a pair of tubular bars 80 (see FIG. 4B) spaced evenly apart so as to receive the guide rollers 78 and enable travel of the car 76 back and forth along the railways. Each bending carriage 66 further has an upper concave bending roller 82 mounted on top of the car 76 for rotation about a vertical axis. Each of the upper bending rollers 82 projects upward above the height of the horizontal platforms 36 of the corresponding lateral frames 34. In this way, each of the upper bending rollers 82 is sized and positioned to contact a lateral end of a linear tube blank B and bend the tube blank around the arch die and into a partial hoop when the bending carriages 66 are displaced longitudinally forward.

As shown in FIGS. 4D-4F, each car 76 has a laterally extending portion that terminates in a vertical guard member or wall 84. The guard wall 84 reaches far enough laterally inward so as to be under the horizontal platform 36 of the corresponding lateral frame 34, and also to the inside of the inner tubular bar of the corresponding railway 66, as shown in FIG. 4C. The chain 74 passes to the outside of the guard wall 84 and is held therein using some sort of fitting. For example, FIG. 4E shows a short series of posts 86 that may be affixed to the guard wall 84, the posts being sized to fit between and thus mesh with the links of the chain 74. Alternatively, a clamp or other sort of fitting may be utilized, or both posts and clamp. Ultimately, this arrangement connects the chain 74 to the car 76, and enables the chain 74 to drive the bending carriage 66. At the same time, the chain 74 is pulled outward from the path of gears of the drive mechanism 70, as described below.

With reference back to FIGS. 4A and 4B, the drive mechanism 70 includes a series of stationary gears 90 mounted to the rigid components of each lateral frame 34. In the illustrated embodiment there are seven stationary gears 90 distributed around the lateral frame 34 in a horizontal plane around which the chain 74 travels. The drive mechanism 70 also includes a drive gear 92 either directly coupled to the motor 72 or via a transmission. As mentioned above, the motors 72 for the drive mechanisms 70 on both lateral sides are activated by the control unit 56 in coordination with the apex clamp 40. Finally, the gearing of the drive mechanism 70 also includes a movable gear 94 located outside a loop of the chain 74. The movable gear 94 is mounted for lateral movement on the respective frame 34, such as on an adjustable telescoped beam 96, to enable tightening or loosening of the chain 74.

Each chain 74 is fixed to a fitting on the bending carriage 66 to drive the bending carriage along the railway 60, mentioned above. The railway 66 in turn is positioned such that the fitting and guard wall 84 pulls the chain 74 off each gear 90 as the bending carriage 66 passes by that gear to avoid contact between the fitting and gear. This can be seen in the lower portion of FIG. 4B where the carriage 66 has translated almost to the end of the straight portion of the railway 60 and has pulled the chain 74 away from the next stationary gear 90. As the carriage 66 translates around the curvilinear portion of the railway 60, the chain 74 is likewise pulled laterally outward away from each of the fixed gears 90 around which the chain is wrapped. The distance outward that the chain 74 is pulled is relatively small to avoid creating the possibility for decoupling of the chain from any of the gears 90.

The railways 64 form a J-shape such that each of the bending carriages 66 travels longitudinally from the starting location 62 and then undergoes a relatively sharp inward turn to the ending location 64. In this regard, the illustrated tubular bars 80 are each segmented into a straight portion and a curved portion, held together in alignment by suitable mounting cleats, and the like. As shown in FIG. 1, for example, the terminal portion of the railways 64 extend underneath the horizontal platforms 36 of the respective lateral frames 34. The arch die 22 terminates at longitudinally-oriented portions at their respective ends 26 which align with supplemental end dies 100 affixed to each lateral frame. Each of the end dies 100 forms a continuation of sort of the arch die 22, such that terminal ends of the tube blank B may be bent inward toward each other. The end dies 100 curve or angle inwardly in approximately 90° bends such that when the bending carriages 66 are displaced to their ending locations 64 on the railways 60 the tube blank B is bent around the end dies. The end dies 100 may be outwardly convex so as to better hold the terminal ends of the tube blank B from popping up.

Figure 5:
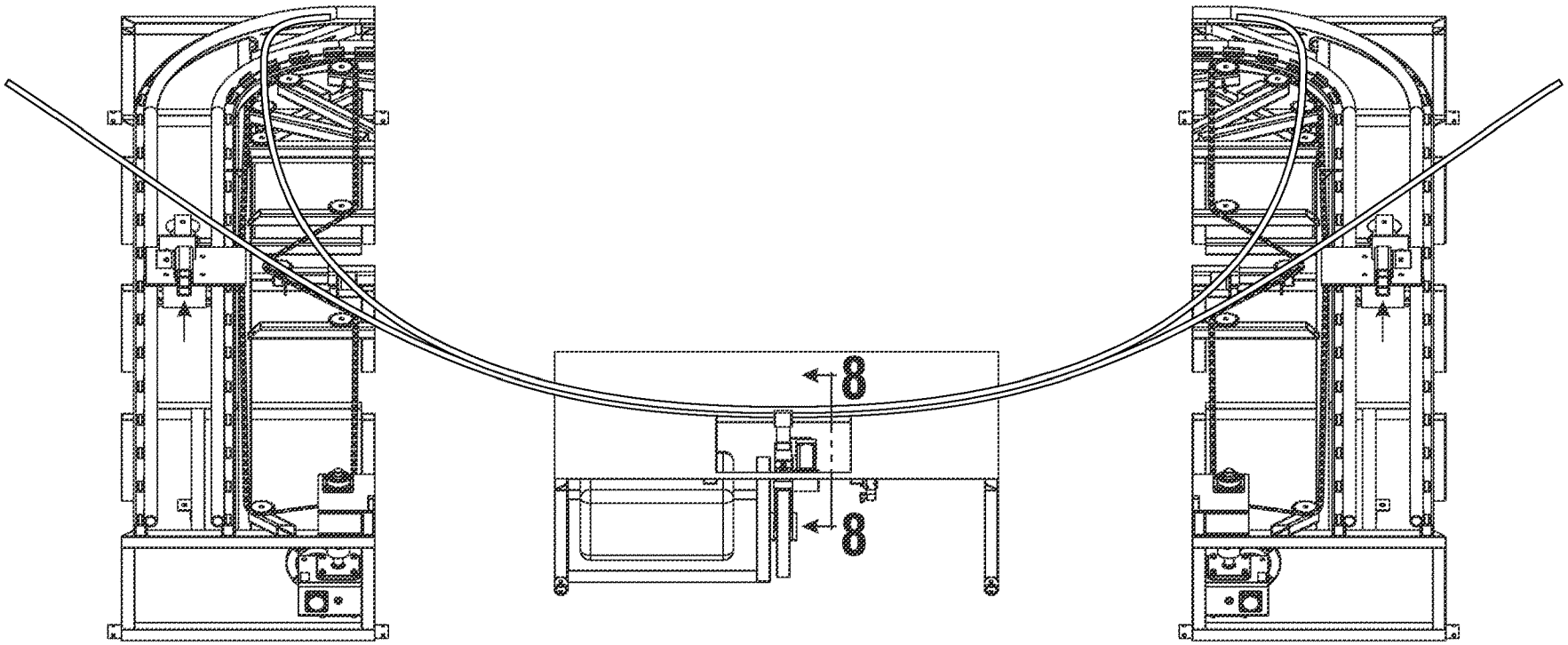
FIG. 5 is a perspective view of the tube bending system in the process of bending a tube blank around an arch die.

FIG. 5 illustrates the entire tube bending system 20 minus the horizontal platforms 32, 36 on which the arch die 22 mounts. The end dies 100 are indicated as inward extensions of the arch die 22 in this illustration. The bending carriages 66 are approximately halfway along the linear portion of the railways 60 in the process of bending the tube blank B into its eventual partial hoop shape. An entire sequence of bending a tube blank B will now be described with respect to FIGS. 6A-6F and 7-8.

Initially, FIG. 6A shows the tube bending system 20 from above prior to advancement of the bending carriages 66. A straight tube blank B is held between the apex clamp 40 and the apex point 24 of the arch die 22. This corresponds to the clamping position shown in FIG. 8A. Prior to this configuration, the apex clamp 40 was in the starting position of FIG. 8C, with the clamp end 44 retracted from the arch die 22 to leave a space therebetween. The tube blank B may be manually positioned between the apex clamp 40 and the arch die 22, and centered across the central frame 30 by the use of various means, such as a central mark on the tube blank B itself.

The control unit 56 includes a processor and programming configured to coordinate activation of the linear actuators and drive mechanism in a predetermined sequence to: a) displace the apex clamp longitudinally forward from its starting position to its clamping position, b) displace both bending carriages longitudinally forward from the starting locations to the ending locations, c) displace both bending carriages longitudinally rearward from the ending locations to the starting locations, d) displace the apex clamp vertically upward to lift and expel the partial hoop from contact with the convex outer surface, and e) displace the apex clamp downward and longitudinally rearward to its starting position.

The control unit 56 may include software and/or hardware for providing functionality and features described herein. The control unit 56 may therefore include one or more of: logic arrays, memories, analog circuits, digital circuits, software, firmware, and processors such as microprocessors, field programmable gate arrays (FPGAs), application specific integrated circuits (ASICs), programmable logic devices (PLDs) and programmable logic arrays (PLAs). The hardware and firmware components of the control unit 56 may include various specialized units, circuits, software and interfaces for providing the functionality and features described here.

Figure 6B:
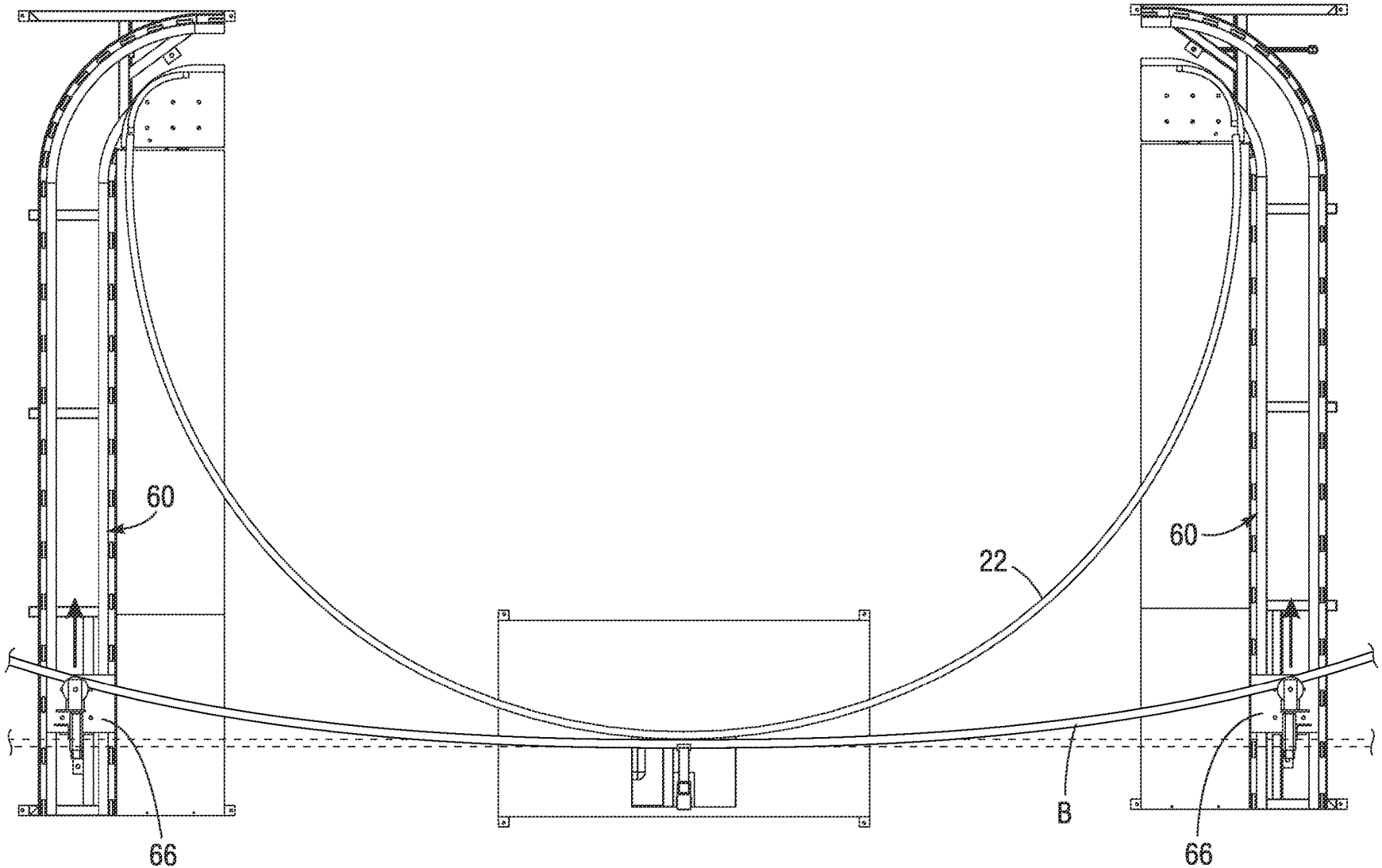

To commence the sequence, FIG. 6B shows initial coordinated advancement of the bending carriages 66 along the respective railway 60. The bending forces are evened out on both sides, and thus the presence of the apex clamp 40 pushing the tube blank B against the arch die 22 is sufficient to maintain the tube blank in place.

Figure 6C:
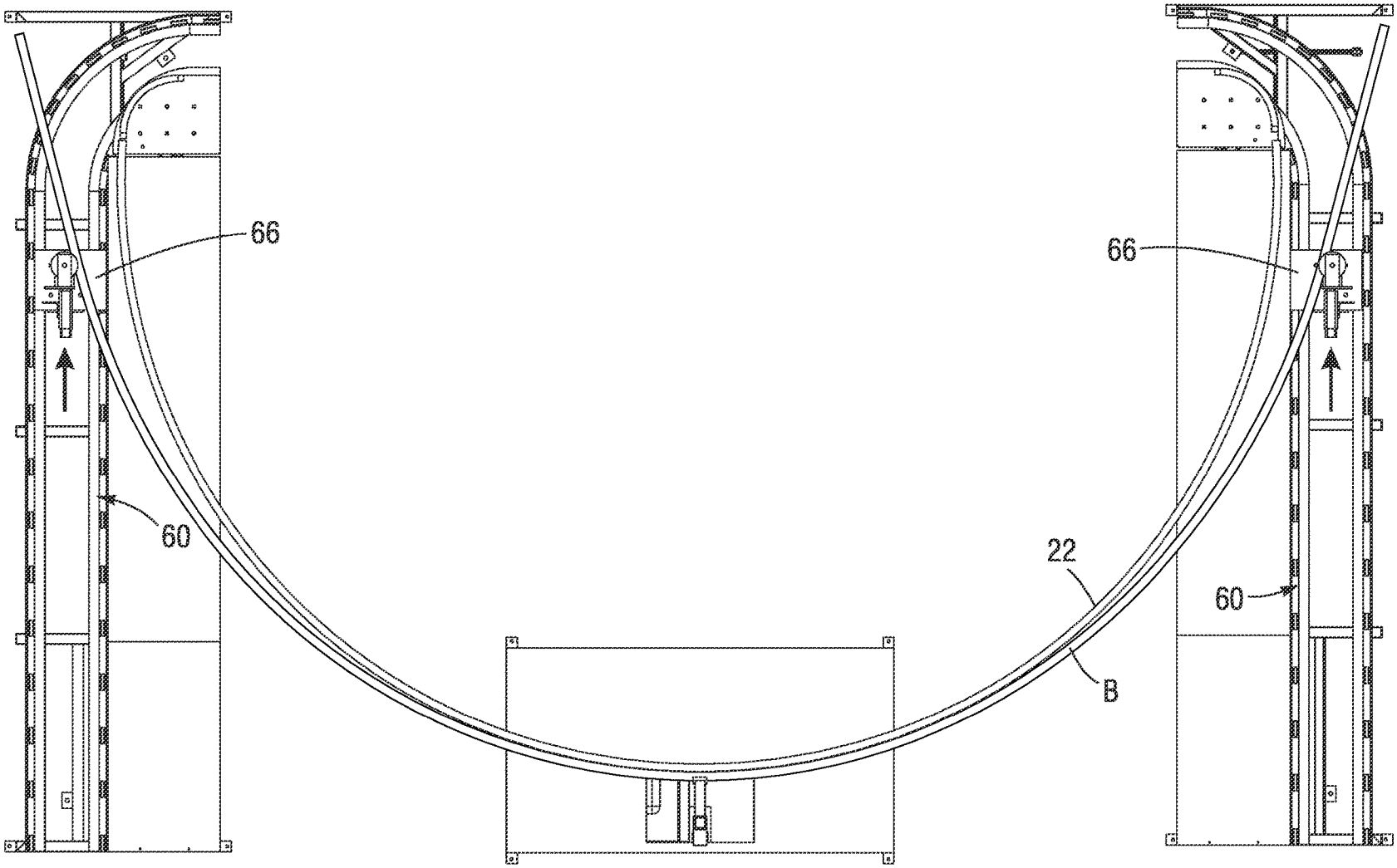
Figure 6D:
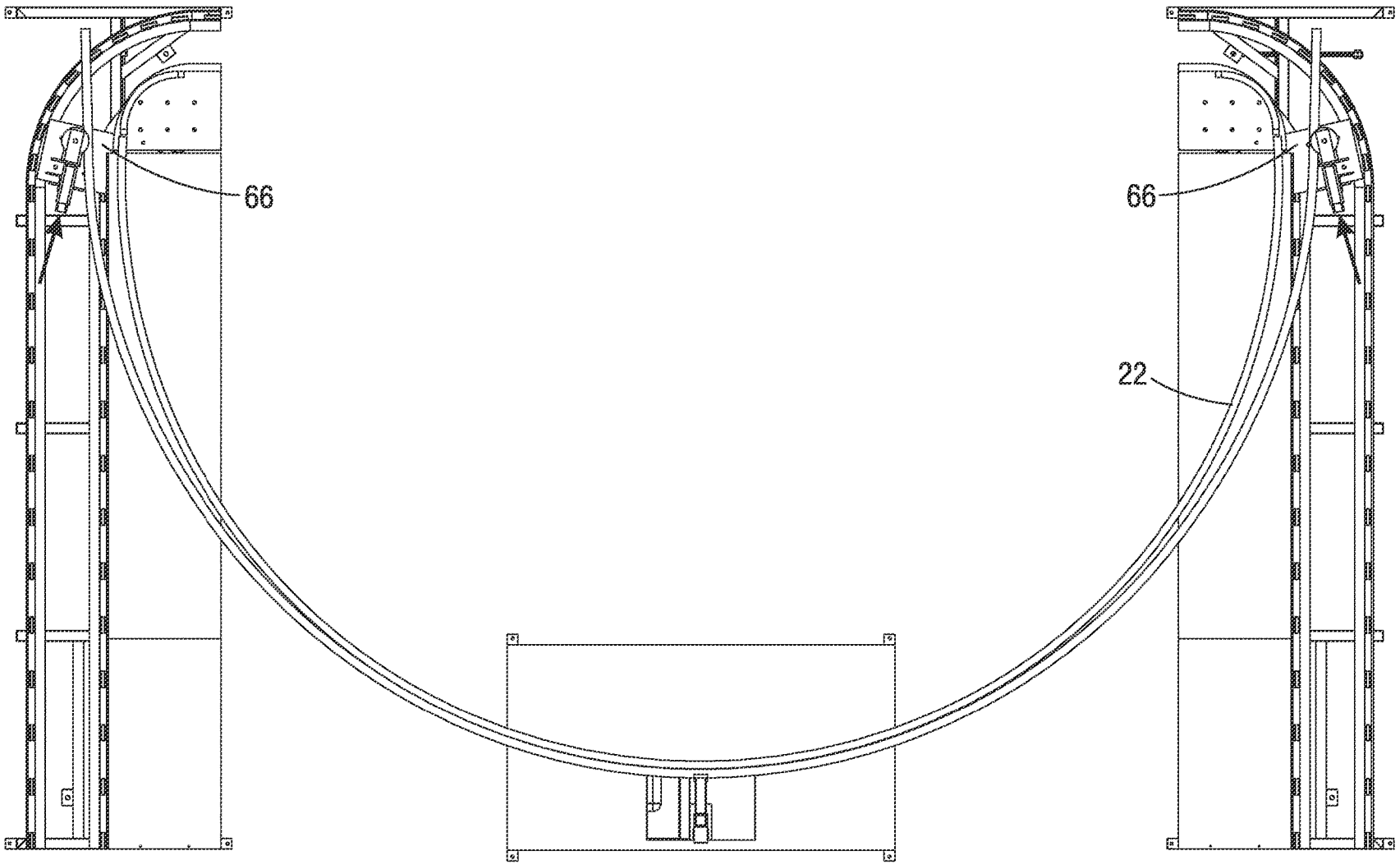
Figure 6E:
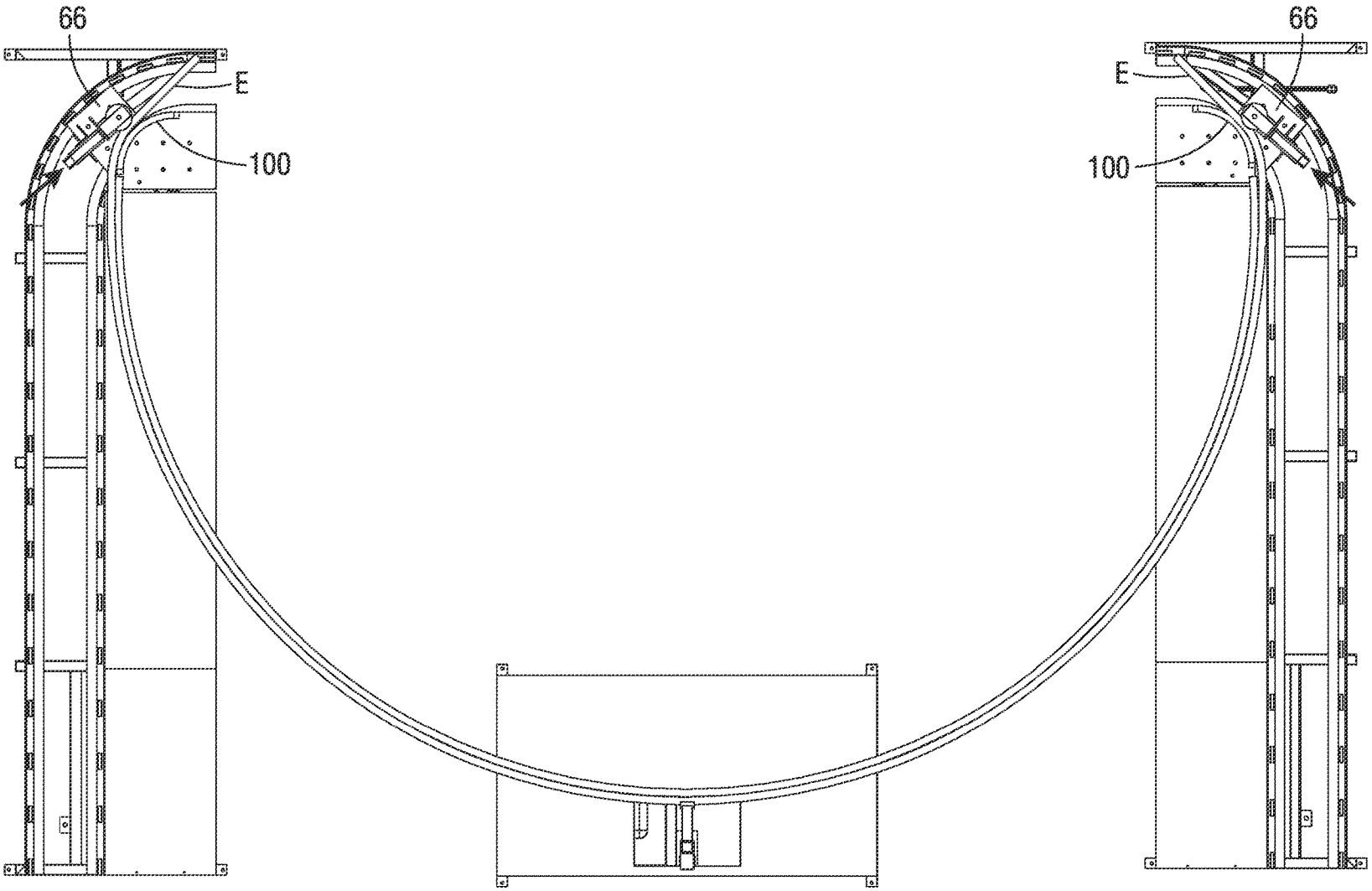
Figure 6F:
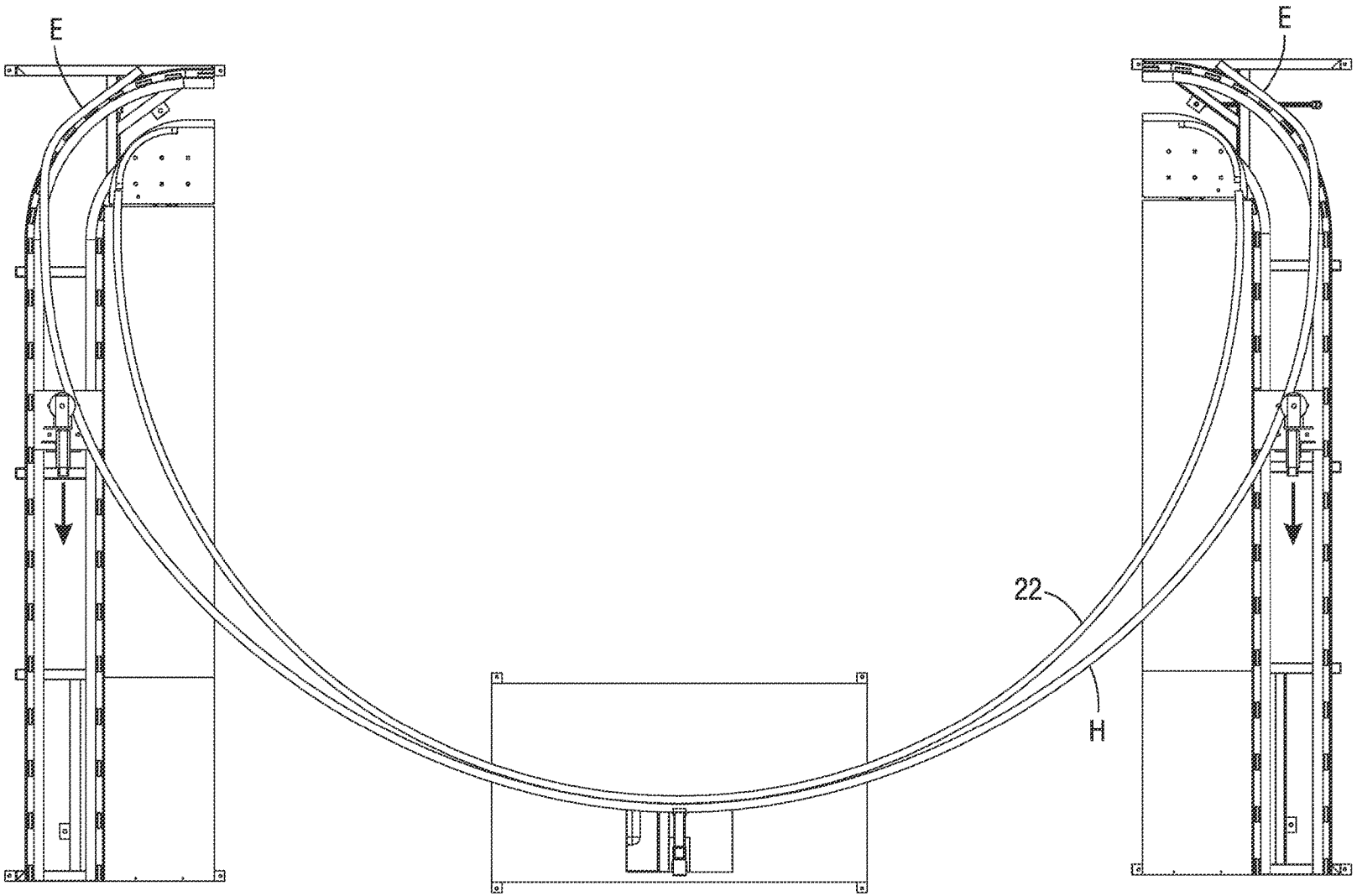

FIG. 6C shows further linear advancement of the bending carriages 66 along the railways 60 such that the tube blank B has been nearly completely bent around the arch die 22. FIG. 6D illustrates the bending carriages 66 curling around the arcuate portions of the railways 60, and FIG. 6E shows the carriages at or near their terminal positions at the ending locations 64 of the railways 60. It is at this terminal position that each of the bending carriages 66 bends the terminal ends E of the tube blank B around the end dies 100 to a greater extent than the curvature around the arch die 22. FIG. 6F then shows retraction of the bending carriages 66 towards their original starting positions. The tube blank B immediately begins to expand from its bent shape to its final partial hoop shape H due to its natural resiliency.

FIG. 7 shows the bending carriages 66 having been retracted to their original starting position at the starting locations of the railways 60. The partial hoop shape H expands from contact with the arch die 22 and it will be seen that the terminal ends E form somewhat linear portions. These linear portions are helpful when utilizing the partial hoop shape H to create hoop houses in the field by providing straight mounting ends which are easier to secure to the ground.

Both FIGS. 7 and 7A show upward movement of the apex clamp 40 which ejects the tube blank B from the tube bending system 20. More particularly, as seen in FIG. 8B, upward movement of the apex clamp 40 lifts the tube blank B upward. By virtue of the natural resiliency of the partial hoop shape H, the tube blank B springs forward onto the top of the arch die 22, thus making it easy for the workers to lift it clear of the tube bending system 20. The apex clamp 40 then retracts to the starting position shown in FIG. 8C, thus making way for the next bending sequence. The entire process may take as little as 15 seconds per cycle.

Closing Comments

Throughout this description, the embodiments and examples shown should be considered as exemplars, rather than limitations on the apparatus and procedures disclosed or claimed. Although many of the examples presented herein involve specific combinations of method acts or system elements, it should be understood that those acts and those elements may be combined in other ways to accomplish the same objectives. Acts, elements and features discussed only in connection with one embodiment are not intended to be excluded from a similar role in other embodiments.

As used herein, "plurality" means two or more. As used herein, a "set" of items may include one or more of such items. As used herein, whether in the written description or the claims, the terms "comprising", "including", "carrying", "having", "containing", "involving", and the like are to be understood to be open-ended, i.e., to mean including but not limited to. Only the transitional phrases "consisting of" and "consisting essentially of", respectively, are closed or semi-closed transitional phrases with respect to claims. Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements. As used herein, "and/or" means that the listed items are alternatives, but the alternatives also include any combination of the listed items.

It is claimed:

1. A tube bending system for bending tube blanks into partial hoops, comprising:

an arch die having a curved shape with two sides curving away from a central apex point to end points and a convex outer surface opposite a concave inner surface, a longitudinal plane being defined radially through the apex point and bisecting the two sides and extending through a central vertical axis of the curved shape;

a stationary central frame having a horizontal platform on which is fixedly mounted a central portion of the arch die, the convex outer surface being vertically dimensioned at least as tall as a tube blank placed on the horizontal platform;

an apex clamp extending above the horizontal platform of the central frame and having a clamp end projecting longitudinally toward the apex point on the convex outer surface of the arch die, the clamp end having a clamping position configured to hold a tube blank against the apex point, the apex clamp being mounted on a reciprocating movement mechanism adapted to displace the clamp end from its clamping position both longitudinally and vertically upward, the clamp end having a starting position for placement of a tube blank on the horizontal platform between the clamp end and the apex point;

a pair of stationary lateral frames separate from and positioned on opposite lateral sides of the central frame, each lateral frame having a horizontal platform on which is fixedly mounted one of the two sides of the arch die, the lateral frames being spaced apart from the central frame such that a linear tube blank clamped against the apex point may be supported across the horizontal platforms of the central and lateral frames, each lateral frame supporting a railway extending longitudinally forward from a starting location approximately laterally even with the apex clamp to an ending location laterally even with or slightly past respective terminal ends of the two sides of the arch die;

a bending carriage arranged to reciprocate longitudinally along each of the railways, the bending carriages each having mounted thereon an upper roller sized to contact a lateral end of a linear tube blank and bend the tube blank around the arch die and into a partial hoop when the bending carriages are displaced longitudinally forward, wherein the reciprocating movement mechanism is configured to elevate the clamp end of the apex clamp from its clamping position after the tube blank has been bent into the partial hoop to lift and expel the partial hoop from contact with the convex outer surface, wherein the railway on each lateral frame extends longitudinally forward from the starting location in a line to an intermediate location, and then curls laterally inward toward the longitudinal plane to the ending location such that displacement of the bending carriages to their ending location bends the lateral ends of the tube blank to a greater extent than a mid-portion; and a drive mechanism on each lateral frame for longitudinally reciprocating the bending carriage along the railway.

2. The system of claim 1, wherein the horizontal platforms of the central frame and lateral frames are each separately adjustable in elevation and horizontal angle.

3. The system of claim 1, wherein each of the lateral frames has a fixed end die mounted above the respective horizontal platform and positioned to be aligned with an end point of the arch die, the end dies having outer surfaces which form continuations of the convex outer surface of the arch die and curve or angle inwardly, such that when the bending carriages are displaced to their ending locations the tube blank is bent around the end dies.

4. The system of claim 1, wherein the railway on each lateral frame is defined by a pair of spaced apart tubular guides, and wherein each of the bending carriages has a pair of lower rollers on each lateral side that engage the tubular guides for smooth displacement along the railways.

5. The system of claim 1, wherein each lateral frame has a motor mounted thereon that drives a chain and a plurality of gears mounted on the lateral frame and spaced apart in a plane around which the chain is guided, the chain being fixed to the bending carriage to drive the bending carriage along the railway, wherein the railway is positioned such that the bending carriage pulls the chain off each gear as the bending carriage passes by that gear to avoid contact between the bending carriage and gear.

6. The system of claim 5, wherein the plurality of gears mounted on each lateral frame includes a plurality of fixed gears and at least one gear that is located outside a loop of the chain and mounted for movement to enable tightening of the chain.

7. The system of claim 1, wherein the clamp end includes a concave forward shape which matches an outer diameter of the tube blank to securely clamp the tube blank against the apex point and reliably lift and expel the partial hoop from contact with the convex outer surface of the arch die.

8. The system of claim 1, wherein the reciprocating movement mechanism of the apex clamp has a linear actuator for displacing the clamp end longitudinally, and a linear actuator for displacing the clamp end vertically.

9. The system of claim 8, wherein the reciprocating movement mechanism includes a control processor and programming configured to coordinate activation of the linear actuators and drive mechanism in a predetermined sequence to: a) displace the apex clamp longitudinally forward from its starting position to its clamping position, b) displace both bending carriages longitudinally forward from the starting locations to the ending locations, c) displace both bending carriages longitudinally rearward from the ending locations to the starting locations, d) displace the apex clamp vertically upward to lift and expel the partial hoop from contact with the convex outer surface, and e) displace the apex clamp downward and longitudinally rearward to its starting position.

10. A tube bending system for bending tube blanks into partial hoops, comprising:

an arch die having a curved shape with two sides curving away from a central apex point to end points and a convex outer surface opposite a concave inner surface, a longitudinal plane being defined radially through the apex point and bisecting the two sides and extending through a central vertical axis of the curved shape;

a stationary central frame having a horizontal platform on which is fixedly mounted a central portion of the arch die, the convex outer surface being vertically dimensioned at least as tall as a tube blank placed on the horizontal platform;

an apex clamp extending above the horizontal platform of the central frame and having a clamp end projecting longitudinally toward the apex point on the convex outer surface of the arch die, the clamp end having a clamping position configured to hold a tube blank against the apex point;

a pair of stationary lateral frames separate from and positioned on opposite lateral sides of the central frame, each lateral frame having a horizontal platform on which is fixedly mounted one of the two sides of the arch die, the lateral frames being spaced apart from the central frame such that a linear tube blank clamped against the apex point may be supported across the horizontal platforms of the central and lateral frames, wherein the horizontal platforms of the central frame and lateral frames are each separately adjustable in elevation and horizontal angle;

a bending carriage arranged to reciprocate longitudinally along each of the lateral frames, the bending carriages each having mounted thereon an upper roller sized to contact a lateral end of a linear tube blank and bend the tube blank around the arch die and into a partial hoop when the bending carriages are displaced longitudinally forward, wherein each lateral frame supports a railway extending longitudinally forward from a starting location approximately laterally even with the apex clamp to an ending location laterally even with or slightly past respective terminal ends of the two sides of the arch die, and the bending carriages are arranged to reciprocate longitudinally along each of the railways, wherein the railway on each lateral frame extends longitudinally forward from the starting location in a line to an intermediate location, and then curls laterally inward toward the longitudinal plane to the ending location such that displacement of the bending carriages to their ending location bends the lateral ends of the tube blank to a greater extent than a mid-portion; and a drive mechanism on each lateral frame for longitudinally reciprocating the bending carriage.

11. The system of claim 10, wherein each of the lateral frames has a fixed end die mounted above the respective horizontal platform and positioned to be aligned with an end point of the arch die, the end dies having outer surfaces which form continuations of the convex outer surface of the arch die and curve or angle inwardly, such that when the bending carriages are displaced to their ending locations the tube blank is bent around the end dies.

12. The system of claim 10, wherein the railway on each lateral frame is defined by a pair of spaced apart tubular guides, and wherein each of the bending carriages has a pair of lower rollers on each lateral side that engage the tubular guides for smooth displacement along the railways.

13. The system of claim 10, wherein each lateral frame has a motor mounted thereon that drives a chain and a plurality of gears mounted on the lateral frame and spaced apart in a plane around which the chain is guided, the chain being fixed to the bending carriage to drive the bending carriage along the lateral frame, and the plurality of gears includes a plurality of fixed gears and at least one gear that is located outside a loop of the chain and mounted for movement to enable tightening of the chain.

14. The system of claim 13, wherein the bending carriages are displaced along each lateral frame such that the bending carriage pulls the chain off each gear as the bending carriage passes by that gear to avoid contact between the bending carriage and gear.

15. The system of claim 10, wherein the apex clamp being mounted on a reciprocating movement mechanism adapted to displace the clamp end from its clamping position both longitudinally and vertically upward, the clamp end having a starting position for placement of a tube blank on the horizontal platform between the clamp end and the apex point, and the clamp end includes a concave forward shape which matches an outer diameter of the tube blank to securely clamp the tube blank against the apex point and reliably lift and expel the partial hoop from contact with the convex outer surface of the arch die.

16. The system of claim 15, wherein the reciprocating movement mechanism of the apex clamp has a linear actuator for displacing the clamp end longitudinally, and a linear actuator for displacing the clamp end vertically.

17. The system of claim 16, wherein the reciprocating movement mechanism includes a control processor and programming configured to coordinate activation of the linear actuators and drive mechanism in a predetermined sequence to: a) displace the apex clamp longitudinally forward from its starting position to its clamping position, b) displace both bending carriages longitudinally forward from the starting locations to the ending locations, c) displace both bending carriages longitudinally rearward from the ending locations to the starting locations, d) displace the apex clamp vertically upward to lift and expel the partial hoop from contact with the convex outer surface, and e) displace the apex clamp downward and longitudinally rearward to its starting position.

18. A tube bending system for bending tube blanks into partial hoops, comprising:

an arch die having a curved shape with two sides curving away from a central apex point to end points and a convex outer surface opposite a concave inner surface, a longitudinal plane being defined radially through the apex point and bisecting the two sides and extending through a central vertical axis of the curved shape;

a stationary central frame having a horizontal platform on which is fixedly mounted a central portion of the arch die, the convex outer surface being vertically dimensioned at least as tall as a tube blank placed on the horizontal platform;

an apex clamp extending above the horizontal platform of the central frame and having a clamp end projecting longitudinally toward the apex point on the convex outer surface of the arch die, the clamp end having a clamping position configured to hold a tube blank against the apex point;

a pair of stationary lateral frames separate from and positioned on opposite lateral sides of the central frame, each lateral frame having a horizontal platform on which is fixedly mounted one of the two sides of the arch die, the lateral frames being spaced apart from the central frame such that a linear tube blank clamped against the apex point may be supported across the horizontal platforms of the central and lateral frames, wherein the horizontal platforms of the central frame and lateral frames are each separately adjustable in elevation and horizontal angle;

a bending carriage arranged to reciprocate longitudinally along each of the lateral frames, the bending carriages each having mounted thereon an upper roller sized to contact a lateral end of a linear tube blank and bend the tube blank around the arch die and into a partial hoop when the bending carriages are displaced longitudinally forward, wherein each lateral frame has a motor mounted thereon that drives a chain and a plurality of gears mounted on the lateral frame and spaced apart in a plane around which the chain is guided, the chain being fixed to the bending carriage to drive the bending carriage along the lateral frame, and the plurality of gears includes a plurality of fixed gears and at least one gear that is located outside a loop of the chain and mounted for movement to enable tightening of the chain, wherein the bending carriages are displaced along each lateral frame such that the bending carriage pulls the chain off each gear as the bending carriage passes by that gear to avoid contact between the bending carriage and gear; and a drive mechanism on each lateral frame for longitudinally reciprocating the bending carriage.

19. A tube bending system for bending tube blanks into partial hoops, comprising:

an arch die having a curved shape with two sides curving away from a central apex point to end points and a convex outer surface opposite a concave inner surface, a longitudinal plane being defined radially through the apex point and bisecting the two sides and extending through a central vertical axis of the curved shape;

a stationary central frame having a horizontal platform on which is fixedly mounted a central portion of the arch die, the convex outer surface being vertically dimensioned at least as tall as a tube blank placed on the horizontal platform;

an apex clamp extending above the horizontal platform of the central frame and having a clamp end projecting longitudinally toward the apex point on the convex outer surface of the arch die, the clamp end having a clamping position configured to hold a tube blank against the apex point, the apex clamp being mounted on a reciprocating movement mechanism adapted to displace the clamp end from its clamping position both longitudinally and vertically upward, the clamp end having a starting position for placement of a tube blank on the horizontal platform between the clamp end and the apex point;

a pair of stationary lateral frames separate from and positioned on opposite lateral sides of the central frame, each lateral frame having a horizontal platform on which is fixedly mounted one of the two sides of the arch die, the lateral frames being spaced apart from the central frame such that a linear tube blank clamped against the apex point may be supported across the horizontal platforms of the central and lateral frames, each lateral frame supporting a railway extending longitudinally forward from a starting location approximately laterally even with the apex clamp to an ending location laterally even with or slightly past respective terminal ends of the two sides of the arch die;

a bending carriage arranged to reciprocate longitudinally along each of the railways, the bending carriages each having mounted thereon an upper roller sized to contact a lateral end of a linear tube blank and bend the tube blank around the arch die and into a partial hoop when the bending carriages are displaced longitudinally forward, wherein the reciprocating movement mechanism is configured to elevate the clamp end of the apex clamp from its clamping position after the tube blank has been bent into the partial hoop to lift and expel the partial hoop from contact with the convex outer surface; and a drive mechanism on each lateral frame for longitudinally reciprocating the bending carriage along the railway, wherein the drive mechanism for each lateral frame comprises a motor mounted thereon that drives a chain and a plurality of gears mounted on the lateral frame and spaced apart in a plane around which the chain is guided, the chain being fixed to the bending carriage to drive the bending carriage along the railway, wherein the railway is positioned such that the bending carriage pulls the chain off each gear as the bending carriage passes by that gear to avoid contact between the bending carriage and gear.

20. The system of claim 19, wherein the plurality of gears mounted on each lateral frame includes a plurality of fixed gears and at least one gear that is located outside a loop of the chain and mounted for movement to enable tightening of the chain.

* * * * *